United States Patent [19]

Mumford

[11] 4,045,907

[45] Sept. 6, 1977

[54] FLOATABLE TOYS

[75] Inventor: Michael Anthony Mumford, Peterborough, England

[73] Assignee: Miles Mumford Limited, England

[21] Appl. No.: 650,359

[22] Filed: Jan. 19, 1976

[30] Foreign Application Priority Data

| | | |
|---|---|---|
| Jan. 17, 1975 | United Kingdom | 2185/75 |
| Sept. 11, 1975 | United Kingdom | 37408/75 |

[51] Int. Cl.[2] ..... A63H 23/04

[52] U.S. Cl. ..... 46/93

[58] Field of Search ..... 46/91, 93

[56] References Cited

U.S. PATENT DOCUMENTS

| | | | |
|---|---|---|---|
| 2,785,505 | 3/1957 | Tomak et al. | 46/93 |
| D. 161,871 | 2/1951 | Reuther | 46/93 X |

FOREIGN PATENT DOCUMENTS

| | | | |
|---|---|---|---|
| 1,258,315 | 1/1968 | Germany | 46/93 |
| 585,015 | 1/1947 | United Kingdom | 46/93 |

*Primary Examiner*—Russell R. Kinsey
*Assistant Examiner*—Robert F. Cutting
*Attorney, Agent, or Firm*—Scrivener, Parker, Scrivener and Clarke

[57] ABSTRACT

A floatable toy, for example a boat, has two hulls and a reservoir or container for water mounted between the hulls. A discharge outlet is connected to the reservoir at or near its bottom and is directed rearwardly of the toy, so that water is discharged from the reservoir through the outlet to provide a reaction with the water on which the toy floats and drive the toy. The reservoir is spaced from the water on which the toy floats even when it is filled with water.

8 Claims, 8 Drawing Figures

FLOATABLE TOYS

The invention relates to floatable toys and particularly, but not exclusively, to toy boats.

A previously proposed toy boat comprises two hulls and a water container mounted between the hulls. A tube extends rearwardly from the rear wall of the container below the surface of the water on which the boat floats. The boat is made of solid bouyant material. When the container is filled with water there is a discharge from the tube which imparts a forward reaction which drives the boat through the water.

The previously proposed boat has the disadvantage that it provides a high drag which severely limits the range and speed of the boat for a given container size. It may be possible to increase the speed and range of the boat by increasing the height of the container, and thus the available pressure head of water in the container, but such an increase in height would make the boat less stable.

The present invention aims to obviate or reduce the above-mentioned disadvantages, and provides a floatable toy having two hulls, a reservoir or container for water mounted between the hulls, and one or more discharge outlets connected to the reservoir at or near its bottom and directed rearwardly of the toy, wherein the reservoir is spaced from the water on which the toy floats even when it is filled with water.

In a presently preferred embodiment described in more detail below the discharge outlet is provided by a nozzle which extends downwardly from the bottom of the reservoir, the nozzle having its opening directed rearwardly of the toy.

Two forms of toy boat in accordance with the invention will now be described, by way of example, with reference to the accompanying drawings, in which.

Figure 1:
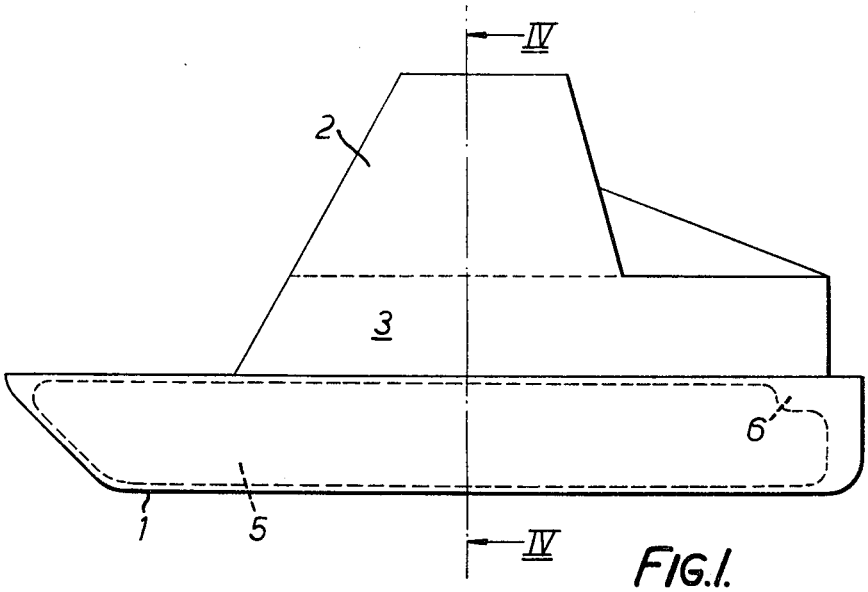
FIG. 1 is a side view of one form of boat.
Figure 2:
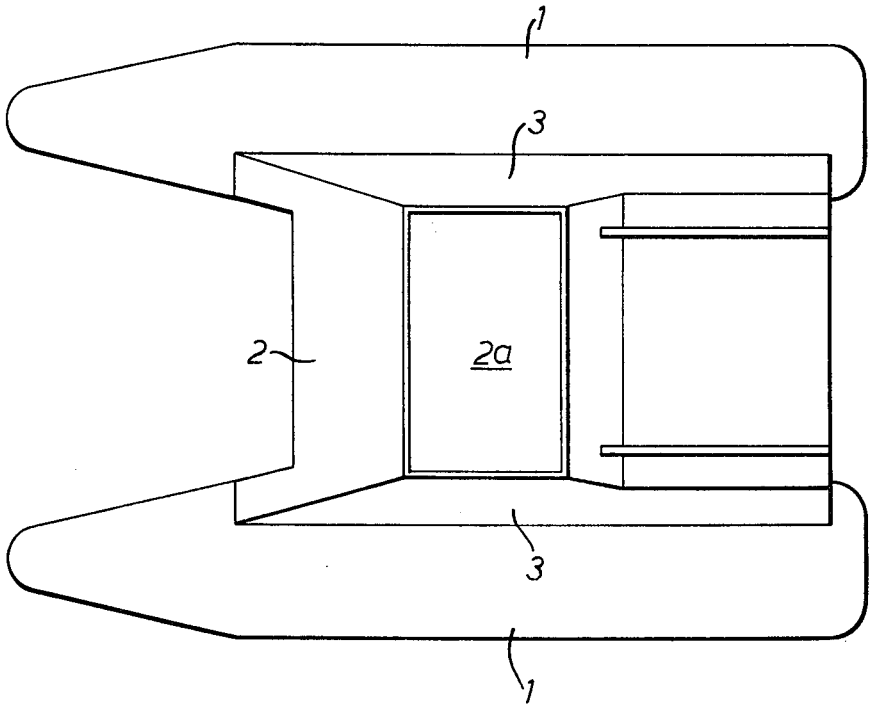
FIG. 2 is a plan view from above of the boat of FIG. 1.
Figure 3:
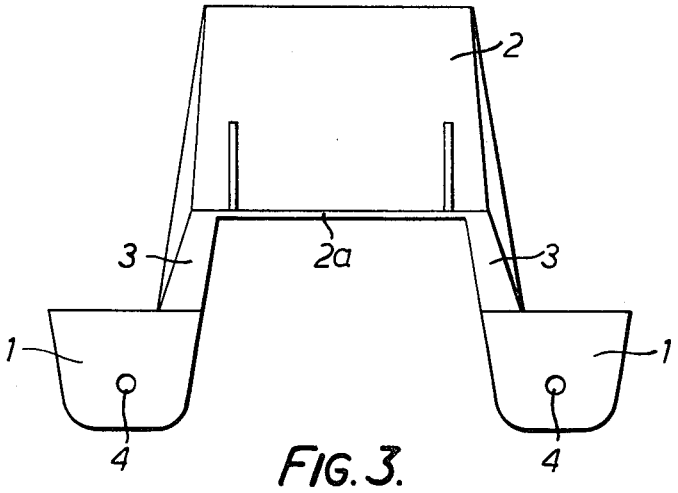
FIG. 3 is a rear view of the boat of FIG. 1.
Figure 4:
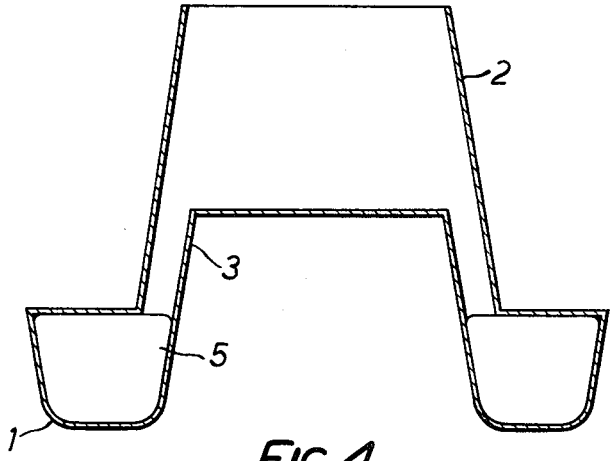
FIG. 4 is a cross-section taken along line IV—IV of FIG. 1.

The form of boat illustrated in FIGS. 1 to 4 comprises two hulls 1 and a reservoir or container 2 which is located between the hulls and held above them by a support in the form of hollow legs 3. Each of the hulls 1 has a discharge opening 4 at its rear end, the openings being equidistantly spaced from the longitudinal axis of the boat. The hollow legs 3 communicate the bottom 2*a* of the reservoir 2 with the discharge openings 4.

Preferably the body of the boat is made from two plastics mouldings secured together as by glueing.

Each hull contains a hollow plastics insert 5 which acts as a boyancy tank and ensures that the boat will float even if there is a leakage in the hull at the join between the two mouldings. Each insert 5 has a recess 6 at its rear end to permit free passage of water from the hollow leg 3 to the opening 4.

Figure 5:
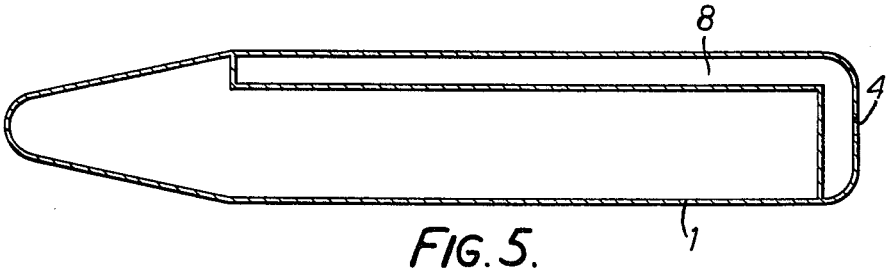
FIG. 5 is a cross-section of a hull of another form of boat.

FIG. 5 illustrates a modified hull 1 having a partition 7 which defines a flow channel 8 located immediately below a corresponding hollow leg 3. Water flows from the reservoir 2 through the legs 3 and channels 8 to the openings 4.

Figure 6:
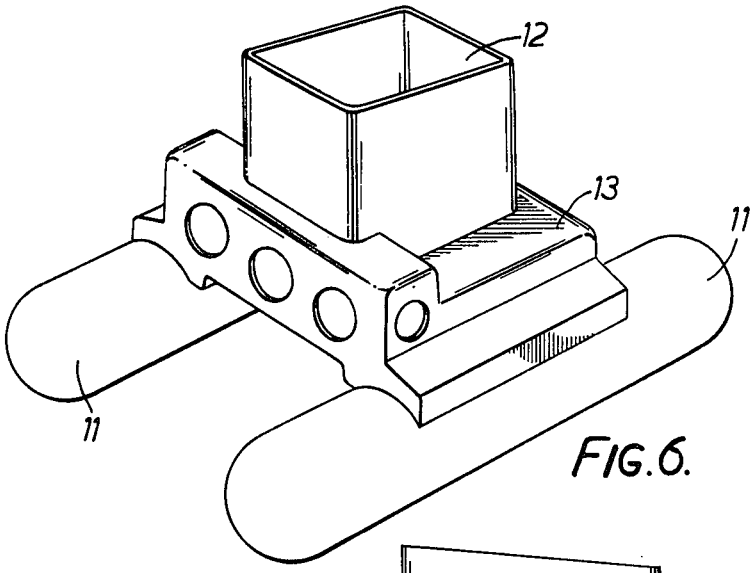
FIG. 6 is a perspective front view of another form of boat.
Figure 7:
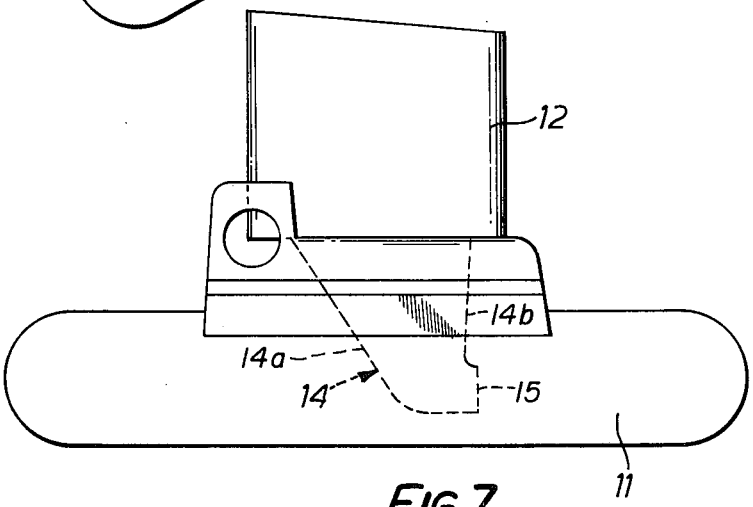
FIGS. 7 and 8 are respectively side and rear elevational view of the form of boat of FIG. 6.
Figure 8:
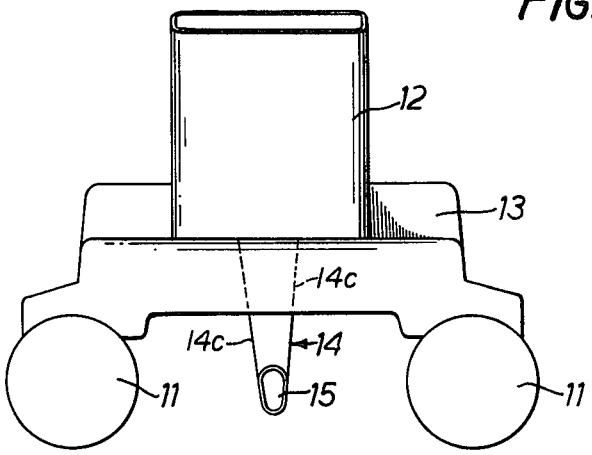

The form of boat illustrated in FIGS. 6 to 8 comprises two closed hulls 11 of generally circular cross-section and a reservoir or container 12 located between the hulls 11. The container 12 is held above and between the hulls by a support platform 13 and has attached to its bottom surface a discharge nozzle 14 having an outlet 15 directed rearwardly. The discharge outlet 15 is located midway between the hulls 11 on the medial longitudinal plane of the boat, but it could be movable to permit steering of the boat.

When the above-described boats are floating on water, the discharge openings 4, 15 are preferably below the water surface even when the reservoir 2 is empty. The bottom of the reservoir 2, 12 is at all times above the water surface, even when it is filled with water. To propel the boat the reservoir 2, 12 is filled with water to provide a pressure head and the water discharges through the opening or openings 4, 15 the reaction causing the boat to move forwardly. It will be noted in FIG. 7 that the forward wall 14*a* of the nozzle slopes downwardly and rearwardly to cooperate with the rear wall 14*b* so as to constrict fluid flow as it travels from the container to the outlet 15. It will be noted in FIG. 8 that the side walls 14*c* of the nozzle also converge downwardly, the effect of the constriction afforded by the converging walls 14*a*, 14*b*, 14*c* being to increase fluid velocity as it emerges from the outlet 15 and enhance the reaction effect propelling the toy through the water.

Each of the above forms of boat is an inexpensive toy which is propelled without the use of motors or other equipment which would add to the cost. It is stable and has the advantage that it can be enjoyed by very young children, since all that is required to set the boat in motion is to submerse it sufficiently to fill the reservoir with water and release it. Upon release the boat moves forwardly. The reservoir is raised above the water line to minimise drag and provide a sufficient pressure head, the two hulls providing the necessary stability.

Although, toy boats have been described above, other shapes could be given to the toy, for example a duck-like body could be used. Furthermore, three or more hulls could be provided. If desired, each of the additional hulls could have a discharge opening provided that the openings on one side of the longitudinal axis have corresponding openings on the other side if the toy is to move in a substantially straight line.

What is claimed is:

1. A floatable toy and adapted to float on water, comprising two hulls, a container for water and means mounting said container on and between said hulls, a discharge outlet connected to said container at or near the bottom thereof, said mounting means being constructed and arranged to maintain said container at all times clear of the surface of water on which said toy floats even when said container is filled with water, said discharge outlet comprising a nozzle which extends downwardly from the bottom of said container and includes an opening directed rearwardly of said toy being constructed and arranged such that when water in said container is allowed to discharge through said outlet, the discharge imparts a forward reaction which drives said toy through the water.

2. A toy according to claim 1 wherein said mounting means includes a support structure connected to each of said hulls, said container being mounted on said support structure.

3. A toy according to claim 1, wherein said hulls are hollow and formed of plastics material.

4. A toy according to claim 1, having only one nozzle, wherein said discharge opening is located on a medial longitudinal plane of said toy.

5. A toy according to claim 1 wherein said nozzle includes downwardly converging walls and said rearwardly directed opening is at the lower end of said walls.

6. A floatable toy adapted to float on water, comprising two hulls, a container for water and means mounting said container on and between said hulls, a discharge outlet connected to said container at or near the bottom thereof, said discharge outlet being directed rearwardly of said toy, said mounting means being constructed and arranged to maintain said container at all times clear of the surface of water on which said toy floats even when said container is filled with water, said discharge outlet being constructed and arranged that when water in said container is allowed to discharge through said outlet, the discharge imparts a forward reaction which drives said toy through the water, said outlet being in one of said hulls, and a second outlet connected to said container and being in the other of said hulls.

7. A toy according to claim 6, including hollow legs connected one to each hull and upon which the container is mounted, wherein said legs define passageways which communicate said container with said hulls.

8. A toy according to claim6, including a hollow insert located within each hull and defining with said hull a passageway for the passage of water from said container to said opening in said hull.

* * * * *